US006521552B1

(12) United States Patent
Honna et al.

(10) Patent No.: US 6,521,552 B1
(45) Date of Patent: Feb. 18, 2003

(54) WATER VAPOR-PERMEABLE, WATERPROOF FABRIC

(75) Inventors: Hiroshi Honna, Ibaraki (JP); Ryoji Tsukamoto, Matsuyama (JP); Makoto Yoshida, Ibaraki (JP); Michikage Matsui, Ibaraki (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/496,284

(22) Filed: Feb. 1, 2000

(30) Foreign Application Priority Data

Feb. 1, 1999 (JP) ..... 11-024076

(51) Int. Cl.[7] ..... B32B 5/02; B32B 5/18; B32B 27/04; B32B 27/12

(52) U.S. Cl. ..... 442/71; 442/64; 442/76; 442/77; 442/86

(58) Field of Search ..... 442/76, 77, 86, 442/64, 71

(56) References Cited

U.S. PATENT DOCUMENTS

| | | | | |
|---|---|---|---|---|
| 4,493,870 A | | 1/1985 | Vrouenraets et al. | |
| 4,725,481 A | * | 2/1988 | Ostapchenko | 428/213 |
| 4,769,273 A | * | 9/1988 | Hoeschele et al. | 428/215 |
| 4,847,142 A | * | 7/1989 | Twilley et al. | 428/315.5 |
| 5,036,551 A | * | 8/1991 | Dailey et al. | 2/167 |
| 5,418,044 A | * | 5/1995 | Mahler | 428/196 |
| 5,447,783 A | | 9/1995 | Horn | |
| 5,506,024 A | * | 4/1996 | Flesher | 428/315.5 |
| 5,532,053 A | * | 7/1996 | Mueller | 428/349 |
| 5,562,977 A | * | 10/1996 | Jager et al. | 428/213 |
| 5,650,225 A | * | 7/1997 | Dutta et al. | 2/167 |
| 5,743,775 A | * | 4/1998 | Baurmeister | 2/16 |
| 6,133,168 A | * | 10/2000 | Doyle et al. | 428/315.5 |
| 6,187,696 B1 | * | 2/2001 | Lim et al. | 442/370 |
| 6,261,678 B1 | * | 7/2001 | von Fragstein et al. | 428/315.5 |

FOREIGN PATENT DOCUMENTS

| | | |
|---|---|---|
| EP | 0 974 696 A1 | 1/2000 |
| JP | 09267456 | 10/1997 |
| JP | 09323390 | 12/1997 |

* cited by examiner

*Primary Examiner*—Chery A. Juska
(74) *Attorney, Agent, or Firm*—Sughrue Mion, PLLC

(57) ABSTRACT

A water vapor-permeable waterproof fabric free from an environmental pollution problem upon being discarded is formed by coating a substrate fiber fabric with a composite coating layer including a lower layer (A) directly formed on the substrate fabric and an upper layer (B) formed on the lower layer (B), wherein the lower and upper layers are formed from one of polyetherester elastomers different from each other and each containing polyalkylene glycol (PAG) residues, and satisfy the following requirements:

(a) in the polyetherester elastomer (PEEA), the polyalkylene glycol residues contain 90% by weight or more of polytetramethylene glycol residues; (b) in the polyetherester elastomer (PEEB), the polyalkylene glycol residues contain 50% by weight or more of polyethylene glycol residues; (c) the thickness of the composite coating layer is 5 to 50 $\mu$m; and (d) the lower layer (A) is in an amount of 5 to 40% by weight based on the total weight of the composite coating layer.

1 Claim, 1 Drawing Sheet

WATER VAPOR-PERMEABLE, WATERPROOF FABRIC

BACKGROUND OF THE INVENTION

1. Field of the Invention

The present invention relates to a water vapor permeable, waterproof fabric. More particularly, the present invention relates to a water vapor-permeable, waterproof fabric which has a coating layer formed on a substrate fabric and comprising thermoplastic polyetherester elastomers and exhibits an excellent water vapor permeability and a high resistance to water permeation therethrough.

2. Description of the Related Arts

When a fabric is worn as clothing on the human body, the clothing is required to exhibit both of a high water vapor permeability to allow a water vapor derived from perspiration generated from the human body to leave through the clothing and a high resistance to permeation of water, for example, rain, through the clothing, to prevent penetration of water into the clothing.

As means for satisfying the above-mentioned two requirements, it is known that one side surface of a substrate consisting of a fiber fabric can be laminated with a film comprising a polytetrafluoroethylene or a polyurethane elastomer, or can be coated with a polyurethane elastomer.

The conventional water vapor permeable, waterproof fabrics produced as mentioned above are environmentally disadvantageous in that when these fabrics are discarded and burnt, the laminated or coated polymers cause gasses harmful for the human body to generate.

Accordingly, the polymer materials for the water vapor-permeable, waterproof fabrics which have both a high water vapor permeability and an excellent waterproof property and cause no or little affect on the environment, are in strong demand.

For this demand, it is expected that the above-mentioned polytetrafluoroethylene and polyurethane elastomers will be replaced by polyetherester elastomers (PEE) which have excellent heat resistance and mechanical properties, are capable of forming films having a moderate elasticity and a good hand, and can be burnt without generating harmful combustion gases.

As a water vapor-permeable, waterproof fabric using the above-mentioned PEE, U.S. Pat. No. 4,493,870 discloses a laminated fabric comprising a film formed from a PEE resin in which at least 70% by weight of polyalkylene glycol (PAG) for forming long chain-formed ester segments have an atomic ratio of carbon atoms to oxygen atoms contained in the molecular chains of 2.0 to 2.4, laminated on a surface of a substrate fabric. The U.S. patent states that the moisture-permeable waterproof fabric exhibits excellent moisture permeability and resistance to water permeation therethrough and is free from environmental problems. The inventors of the present invention studied the water vapor-permeable waterproof fabric of the U.S. patent, and found that the PEE film is fixed to the substrate fabric through an adhesive agent, and when a polyurethane resin is used as an adhesive agent, and the resultant laminated fabric is discarded and burnt, the polyurethane resin contained in the laminated fabric, even in a small amount, causes generation of a poisonous gas. Also, the inventors of the present invention found that, in the production of the laminated fabric of the U.S. patent, the PEE resin must be formed into a film before laminating procedure, and the film-formation procedure causes the cost of the laminated fabric production to be high in composition with that produced by the coating procedure. Namely, the disadvantages of the water vapor-permeable, waterproof fabric of the U.S. patent as mentioned above are inherent to the fabric produced by the lamination method.

Also, it was found that when the PEE resin layer as mentioned above is formed by the coating layer, since the 70 weight % or more of the PAG from which long chain ester segments are formed are ones having an atomic ratio of carbon atoms to oxygen atoms contained in the molecular chains of 2.0 to 2.4, the PEE resin is difficult to form into a coating layer on the substrate fabric surface with a uniform thickness over the entire surface of the fabric, while the resultant PEE coating layer exhibits a high water vapor-permeability. The above-mentioned difficulty is inherent to the PEE resin per se.

The problems on the coating layer will be further discussed in detail below.

The water vapor-permeability of the PEE resin is derived from the PAG moieties contained in the molecular chain structures of the PEE and having a high hydrophilicity. Thus, the higher the content of moieties derived from polyethylene glycol which has a higher hydrophilicity than that of other polyalkylene glycols in the coated PEE layer, the higher the water vapor permeability of the coated PEE layer. However, the PEE resin having a high content of the polyethylene glycol moieties is disadvantageous in that when the coating liquid containing the PEE is coated on the substrate fabric, the coating liquid easily penetrates into the inside of the substrate fabric. Namely, in the resultant coated fabric, the resultant surface-coating layer of the PEE resin has a small thickness in view of the total amount of the PEE resin applied to the surface of the substrate fabric, and is disadvantageous in that the thickness of the surface coating layer is uneven in response to ununiform penetration of the coating liquid into the inside of the substrate fabric. Therefore, the resultant coated fabric exhibited a significantly poorer waterproofness than that of the PEE film-laminated, water vapor-permeable, waterproof fabric of the U.S. patent.

Namely, when the PEE layer of the U.S. patent is formed on the substrate fabric surface by the coating method in place of the laminating method disclosed in the U.S. patent, the coating liquid for the PEE layer cannot coat the substrate fabric surface with uniform thickness, and thus the resultant coated PEE layer is uneven in the thickness thereof and thus exhibits a poor resistance to water penetration because water can easily penetrate into the substrate fabric through thin portions of the coated PEE layer.

The resistance to water penetration of the coated PEE layer can be enhanced by increasing the average thickness thereof. The increase in the average thickness causes the resultant PEE-coated fabric to exhibit a reduced softness and poor water vapor-permeability.

Also, the inventors of the present invention further found that the PEE film-laminated, water vapor-permeable, waterproof fabric the U.S. patent is unsatisfactory in wear resistance thereof and thus the wear resistance should be improved.

Accordingly, the PEE-coated fabric having a coated PEE layer with a uniform thickness and exhibiting both a satisfactory water vapor permeability and a sufficient resistance to water permeation, is not yet practically available.

SUMMARY OF THE INVENTION

An object of the present invention is to provide a water vapor-permeable waterproof fabric having a composite coating layer comprising polyetherester elastomers and formed on a substrate fabric, and exhibiting a satisfactory softness, a sufficient water vapor-permeability and an excellent resistance to water (hydraulic) pressure, and a process for producing the same while solving a problem such that a coating liquid containing the polyetherester elastomer easily penetrates into the inside of the substrate fabric. Another object of the present invention is to provide a water vapor-permeable waterproof fabric having a high wear resistance in addition to the satisfactory softness, sufficient water vapor-permeability and excellent water pressure resistance, and a process for producing the same.

The above-mentioned objects can be attained by the water vapor-permeable waterproof fabric and the process for producing the same, of the present invention.

The water vapor-permeable waterproof fabric of the present invention comprises:

a substrate fabric comprising a fiber material; and a composite coating layer formed at least a portion of the surfaces of the substrate fabric and containing (A) a lower layer directly bounded to the substrate fabric and (B) an upper layer formed on the lower layer, wherein the lower and upper layers (A) and (B) comprise one of two polyetherester elastomers (PEE) different in coating layer-forming property from each other, and each comprising polyalkylene glycol (PAG) residues, alkylene glycol (AG) residues and dicarboxylic acid (DC) residues, and satisfy the following requirements:

(a) in the polyetherester elastomer (PEEA) for the lower layer (A), the polyalkylene glycol (PAG), residues contain polytetramethylene glycol residues in a content of 90% by weight or more;

(b) in the polyetherester elastomer (PEEB) for the upper layer (B), the polyalkylene glycol (PAG): residues contain polyethylene glycol residues in a content of 50% by weight or more;

(c) the thickness of the composite coating layer is in the range of from 5 to 50 $\mu$m; and (d) the lower layer (A) is in an amount of 5 to 40% by weight based on the total weight of the composite coating layer including the lower and upper layers (A) and (B).

The process of the present invention for producing a water vapor-permeable waterproof fabric comprises coating at least a portion of the surfaces of a substrate fabric comprising a fiber material with a composite coating layer comprising (A) a lower layer and (B) an upper layer, wherein the lower layer (A) is formed on and bonded directly to at least a portion of the surfaces of substrate fabric, and the upper layer (B) is formed on and bonded to the lower layer (A), and the lower and upper layers (A) and (B) comprise one of two polyetherester elastomers (PEE) different in coating layer-forming property from each other, and each comprising polyalkylene glycol (PAG) residues, alkylene glycol (AG) residues and dicarboxylic acid (DC) residues, and satisfy the following requirements;

(a) in the polyetherester elastomer (PEEA) for the lower layer (A), the polyalkylene glycol (PAG) residues contain polytetramethylene glycol residues in a content of 90% by weight or more;

(b) in the polyetherester elastomer (PEEA) for the upper layer (B), the polyalkylene glycol (PAG) residues contain polyethylene glycol residues in a content of 50% by weight or more;

(c) the thickness of the composite coating layer is in the range of from 5 to 50 $\mu$m; and (d) the lower layer (A) is in an amount of 5 to 40% by weight based on the total weight of the composite coating layer including the lower and upper layers (A) and (B).

DESCRIPTION OF THE PREFERRED EMBODIMENTS

Figure 1:
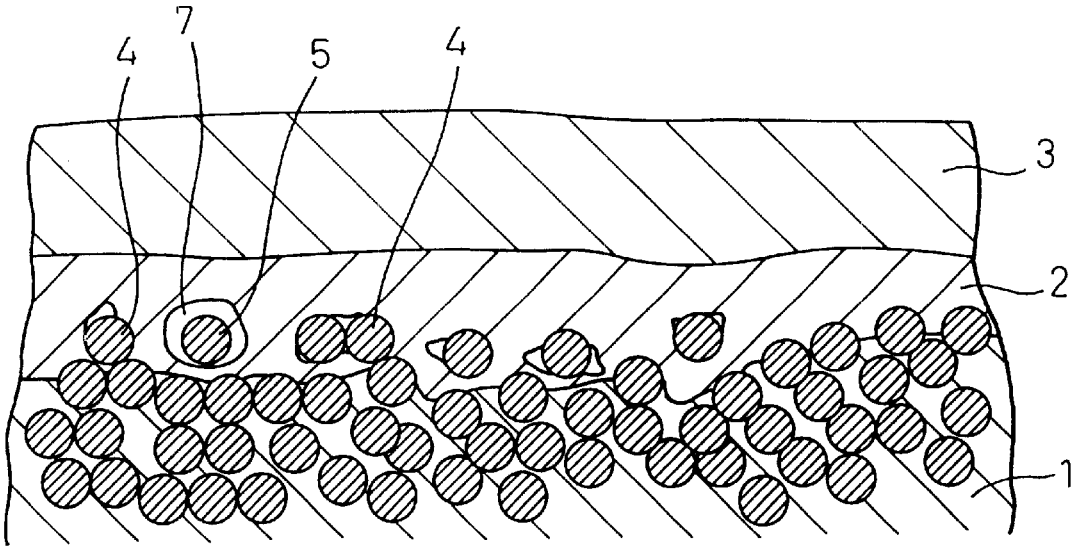
FIG. 1 shows a cross-sectional profile, of an embodiment of the water vapor permeable waterproof fabric of the present invention, in the direction of the thickness of the fabric.

The inventors of the present invention carried out an extensive study on the water vapor-permeable waterproof fabric and found that a composite coating layer having a uniform thickness, a satisfactory water vapor-permeability and a sufficient water pressure resistance could be formed on a substrate fabric by directly coating the substrate fabric with a lower layer comprising a polyetherester elastomer having an excellent coating layer-forming property, and then by coating the lower layer with an upper layer comprising a polyetherester elastomer different from that for the lower layer and having a high water vapor permeability. The composite coating layer of the present inventions exhibits a satisfactory water vapor-permeability, a sufficient resistance to penetration of water under pressure, and an enhanced coating layer-forming property.

In the water vapor-permeable waterproof fabric of the present invention, a composite coating layer is formed on at least a portion of at least one surface of a substrate fabric comprising a fiber material. The composite coating layer is formed by directly coating the substrate fabric with a lower layer (A) comprising a polyetherester elastomer (PEEA) having an excellent coating layer-forming property, and then further coating the lower layer (A) with an upper layer (B) comprising a polyetherester elastomer (PEEB) having an excellent water vapor-permeability. In this composite coating layer, the lower layer (A) is formed on the surface of the substrate fabric while restricting the penetration of a coating liquid containing the polyetherester elastomer (PEEA) for the lower layer (A) into the inside of the substrate fabric, and when liquid containing the polyetherester elastomer (PEEB) for the upper layer (B) is coated on the resultant lower layer (A), the lower layer (A) prevents or restricts the penetration of the coating solution into the inside of the substrate fabric. Thus, the resultant composite coating layer has a sufficient and uniform thickness. This thickness is larger than that of a coating layer formed on the substrate fabric while allowing the coating liquid containing the PEE in the same amount as the total amount of the coating liquids for the lower and upper layers (A) and (B) of the present invention to penetrate into the inside of the substrate fabric.

In the composite coating layer of the present invention, optionally an intermediate layer (C) is formed between the lower layer (A) and the upper layer (B) and optionally, an outer layer (D) is formed on the upper layer (B). The intermediate and outer layers (C) and (D) will be explained in detail later. Preferably, the composite coating layer of the present invention comprises only the lower and upper layers (A) and (B), because the addition of the intermediate layer (C) and/or the outer layer (D) causes the resultant composites coating layer to have too large a total thickness.

In the water vapor-permeable waterproof fabric of the present invention, it is important that the PEEB having a high water vapor permeability is not directly coated on at least one surface of the substrate fabric, and the substrate fabric is first coated with the PEEA having a high coating layer-forming property to form a lower layer (A) and then the lower layer (A) is coated with the PEEB. Namely, since a lower layer (A) is formed with a uniform thickness on the substrate fabric, the PEEB having a relatively low coating layer-forming property can form an upper layer (B) with a uniform thickness.

Accordingly, a coated fabric produced by coating a surface of a substrate fabric with the PEEB and then by coating the PEEB layer with the PEEA, and another coated fabric produced by coating a surface of a substrate fabric with a composition comprising the PEEA and the PEEB, fall outside of the scope of the present invention.

The term "an excellent coating layer-forming property" refers to such a property of a coating liquid containing the PEEA for the lower layer (A) that substantially none or a very small amount of the coating liquid can penetrate into the inside of a substrate fabric and it can form a coating layer adhered to the substrate fabric with a satisfactory peeling strength, and having a substantially uniform thickness.

In the water vapor-permeable waterproof fabric of the present invention, it is also important that the: composite coating layer comprises a lower layer (A) directly coated on the substrate fabric surface and comprising the PEEA having an excellent coating layer-forming property and an upper layer (B) formed on the lower layer (A) and comprising the PEEB having a high water vapor-permeability. Generally, it is believed that the thickness of the composite coating layer of a water vapor-permeable waterproof fabric must be 5 $\mu$m or more to enable the resultant fabric to exhibit a satisfactory resistance to water penetration under pressure, but riot more than 50 $\mu$m to enable the resultant fabric to exhibit a satisfactory hand. Under such conditions that the thickness of the coating layer is restricted to a specific range, when the coating layer is formed only from the resin, such as the PEEA, having a relatively low water vapor-permeability, the resultant coated fabric cannot exhibit a satisfactory water vapor-permeability per coating amount of the resin. In the present invention, however, since the lower layer (A) comprising the PEEA is formed in an amount as small as possible, as long as the resultant lower layer (A) can firmly bond, the upper layer (B) to the substrate fabric therethrough, and the upper layer (B) is formed from the PEEB having a high water vapor-permeability per coating amount thereof, the resultant composite coating layer can exhibit, as a whole, a high water vapor permeability per total coating amount of the lower and upper layers (A) and (B). Accordingly, to obtain a high water vapor-permeability per the total coating amount, the coating amount of the lower layer (A) comprising the PEEA is 40% by weight or less based on the total weight of the composite coating layer. The lower limit of the coating amount of the lower layer (A) is variable in response to the types of the PEEA, PEEB and the substrate fabric. Usually, the coating amount of the lower layer (A) is preferably 5% by weight or more based on the total coating weight of the composite coating layer. More preferably, the lower layer (A) is formed in an amount of 5 to 30% by weight based on the total weight of the composite coating layer. The term "a thickness of the lower layer (A) refers to a difference between the average thickness of the lower layer (A)-coated fabric and the average thickness of the substrate fabric, and thus does not include a thickness of a portion of the PEEA penetrated into the inside of the substrate fabric.

The details of the composite coating layer of the water vapor-permeable waterproof fabric of the present invention will be illustrated below.

In the water vapor-permeable waterproof fabric of the present invention, a substrate fabric is coated on at least a portion the surfaces thereof with a composite coating layer containing a lower layer (A) directly bonded to the substrate fabric and an upper layer (B) formed on the lower layer (A).

The lower and upper layers (A) and (B) respectively comprises one of two polyetherester elastomers (PEE); different in coating layer-forming property from each other. Each of the polyetherester elastomers (PEE) comprises polyalkylene glycol (PAG) residues, alkylene glycol (AG) residues and dicarboxylic acid (DC) residues.

The lower and upper layers (A) and (B) in the composite coating layer satisfy the following requirements:

(a) in the polyetherester elastomer (PEEA) for the lower layer (A), the polyalkylene glycol (PAG) residues contain polytetramethylene glycol residues in a content of 90% by weight or more;

(b) in the polyetherester elastomer (PEEB) for the upper layer (B), the polyalkylene glycol (PAG) residues contain polyethylene glycol residues in a content of 50% by weight or more;

(c) the thickness of the composite coating layer is in the range of from 5 to 50 $\mu$m; and (d) the lower layer (A) is in an amount of 5 to 40% by weight based on the total weight of the composite coating layer including the lower and upper layers (A) and (B).

With respect to requirement (a), when the content of the polytetramethylene glycol residues in the polyalkylene glycol (PAG) residues is less than 90% by weight, the resultant lower layer (A) exhibits an unsatisfactory coating layer-forming property and when the PEEA-containing coating layer is applied to the substrate fabric surface, the coating liquid easily penetrates in too large an amount into the inside of the substrate fabric.

The PEEA for the lower layer (A) is close in chemical composition to the PEEB for the upper layer (B), exhibits a high affinity to the PEEB and thus the lower layer (A) and upper layer (B) are bonded at the interface therebetween to each other with a high bonding strength. The lower layer (A) comprising the PEEA serves as a bonding layer between the upper layer (B) containing the PEEB and the substrate fabric. Thus, the PEEA-containing lower layer (A) preferably exhibits a high flexibility so that when the resultant water vapor-permeable waterproof fabric is deformed, the lower layer (A) can relieve a stress generated due to a difference in deformation between the substrate fabric and the upper layer (B).

To increase the flexibility of the PEEA, the content of tetramethylene glycol residues in the alkylene glycol (AG) residues is preferably as high as possible. More preferably, the content of the tetramethylene glycol in the AG residues is 80 to 100 molar %.

In requirement (b), the polyalkylene glycol (PAG) residues in the PEEB for the upper layer (B) must contain polyethylene glycol residues in a content of 50% by weight or more. When the content of the polyethylene glycol residues in the PAG residues is less than 50% by weight, the resultant PEEB cannot form the upper layer (B) sufficient to compensate a for reduction in the water vapor-permeability due to the arrangement of the PEEA-containing lower layer having a low water vapor-permeability and to enable the resultant coated fabric to exhibit a satisfactory water vapor-permeability. Preferably, the polyethylene glycol residues in the PAG residues are in a content of 80 to 100% by weight. Even when the PEEB having a high content of polyethylene glycol residues in the PAG residues, since the surface of the substrate fabric on which the PEEB-containing upper layer (B) is coated, is previously coated with the PEEA-containing lower layer (A), having a uniform thickness, the resultant water vapor-permeable waterproof fabric has a uniform thickness.

Where the PEEB-containing upper layer forms an outermost layer of the water vapor-permeable waterproof fabric, the PEEB is preferably selected from ones having a high wear resistance. The high wear resistance PEEB is preferably selected from those in which the alkylene glycol (AG) residues comprise ethylene glycol residues and tetramethylene glycol residues, and the content of the ethylene glycol residues in the AG residues is 30 molar % or more, more preferably 30 to 60 molar %. The ethylene glycol residues contained in the content of 30 molar % or more in the AG residues contribute to enabling the resultant water vapor-permeable waterproof fabric to exhibit a sufficient wear resistance. More preferably, in the AG residues, the ethylene glycol residues and tetramethylene glycol residues are present in a molar ratio of 50:50 to 35:65.

In both the PEEA for the lower layer (A) and the PEEB for the upper layer (B), the dicarboxylic acid (DC) residues are preferably derived from aromatic dicarboxylic acids, for example, terephthalic acid, isophthalic acid, phthalic acid, naphthalene-2,6-dicarboxylic acid, naphthalene-2,7-dicarboxylic acid, diphenyl-4,4-dicarboxylic acid, diphenoxyethane dicarboxylic acid, and sodium 3-sulfoisophthalate; cycloaliphatic dicarboxylic acids, for example, 1,4-cyclohexane dicarboxylic acid; aliphatic dicarboxylic acids, for example, succinic acid, oxalic acid, adipic acid, dodecane dicarboxylic acid and dimer acids; and ester-forming derivatives of the above-mentioned dicarboxylic acids. Preferably, terephthalic acid, isophthalic acid, naphthalene-2,6-dicarboxylic acid and ester-forming derivatives thereof are employed as the dicarboxylic acid (DC) residues.

A portion of the dicarboxylic acid (DC) residues, preferably 30 molar % or less, based on the total molar amount of the DC residues, may be replaced by at least one member selected from other dicarboxylic acids than those mentioned above and hydroxycarboxylic acids.

In each of the PEEA and the PEEB, the polyalkylene glycol (PAG) residues may contain, as a portion thereof, at least one member selected from, for example, polyethylene glycol residues, poly-1,2-polypylene glycol residues, poly-1,3-propylene glycol residues, polytetramethylene glycol residues and residues of copolymers of ethylene oxide with propylene oxide, as long as the PEEA and PEEB satisfy requirements (a) and (b). The polyalkylene glycols (PAG) residues for both the PEEA and the PEEB preferably have a number average molecular weight of 600 to 8,000, more preferably 1,000 to 5,000. When the molecular weight is less than 600, the resultant PEEA-containing lower layer (A) and PEEB-containing upper layer (B) may exhibit unsatisfactory mechanical properties. Also, when the molecular weight is more than 8,000, an undesirable phase-separation may occur in the resultant polymers and thus the target PEEA or PEEB are difficult to prepare.

In each of the PEEA and PEEB, the alkylene glycol (AG) residues may include at least one member selected from, for example, ethylene glycol residues, propylene glycol residues trimethylene glycol residues and tetramethylene glycol residues.

In each of the PEEA for the lower layer (A) and the PEEB for the upper layer (B), preferably the polyalkylene glycol (PAG) residues and the alkylene glycol (AG) residues and the dicarboxylic acid (DC) are present in a weight ratio (PAG/(AG+DC)) in the range of from 30:70 to 70:30, more preferably 40:60 to 60:40. When the ratio (PAG/AG) is less than 30/70, the resultant PEEA or PEEB may exhibit an unsatisfactory flexibility, and when the ratio (PAG/(AG+DC)) is more than 70/30, the resultant PEEA or PEEB may have too low a melting temperature.

The PEEA for the lower layer (A) and the PEEB for the upper layer (B) preferably have an intrinsic viscosity [η] in the range of from 0.8 to 1.4, determined in a solvent mixture of phenol with tetrachloroethane in a weight ratio of 6:4 at a temperature of 35° C., to obtain a satisfactory coating layer-forming property and to form a coating layer having a high mechanical strength. The PEEA and PEEB optionally contain an additive selected from, for example, stabilizing agents and ultraviolet ray-absorbing agents.

In the water vapor-permeable waterproof fabric of the present invention, the substrate fabric is not limited to specific fabrics as long as the fabric comprises a fiber material. The fibers for the substrate fabric are preferably selected from polyester fibers, for example, polyethylene terephthalate fibers, polyamide fibers, for example, nylon 6 and nylon 66 fibers, acrylonitrile polymer or copolymer fibers, vinyl polymer or copolymer fibers, semisynthetic fibers, for example, cellulose triacetate fibers, and mixtures of the above-mentioned fibers, for example, polyethylene terephthalate fiber-cotton mixtures and nylon 6 fiber-cotton mixtures. The substrate fabric may be in the form of a woven fabric, nitted fabric or nonwoven fabric.

In the water vapor-permeable waterproof fabric of the present invention, the composite coating layer, optionally further comprises at least one intermediate layer (C) formed between the lower layer (A) and the upper layer (B) and comprising a polyetherester elastomer, which comprises polyalkylene glycol residues, alkylene glycol residues and dicarboxylic acid residues, and is different from the polyetherester elastomers (PEEA and PEEB) for the lower and upper layers (A) and (B).

The polyetherester elastomer contained in the intermediate layer (C) preferably comprises, as polyalkylene glycol (PAG) residues, polyethylene glycol (PEG) residues and polytetramethylene glycol residues at a mixing weight ratio of 11:89 to 49:51.

Preferably, the intermediate layer (C) is in an amount of 20% by weight or less based on the total weight of the composite coating layer.

In the water vapor-permeable waterproof fabric of the present invention, the composite coating layer optionally further comprises at least one outer layer (D) formed on the upper layer (B) and comprising a polymeric material different from the polyetherester elastomer (PEEB) for the upper layer (B).

The polymeric material for the outer layer (D) preferably comprises a member selected from:

water-repellent polymeric materials, silicone polymeric materials, the same polyetherester elastomers as those for the intermediate layer (C), and the same polyetherester elastomers as those for the lower layer (A).

The outer layer (D) is preferably present in an amount of 20% by weight or less, based on the total weight of the composite coating layer.

In the water vapor-permeable waterproof fabric of the present invention, the substrate fabric optionally further comprises a water repellent agent.

The water repellent agent is preferably selected from paraffin-containing water repellent agents, polysiloxane-containing water repellent agents and fluorine compound-containing water repellent agents, and is preferably contained in an amount of 0.1 to 2.0% by weight based on the weight of the substrate fabric.

In the water vapor-permeable waterproof fabric of the present invention, optionally, in a cross-section of the coating layer in parallel to the surface of the composite coating layer, the composite coating layer contains a plurality of fine pores independent from each other, and having an average pore size of 5 to 50 μm, and the total of the cross-sectional areas of the pores corresponds to 5 to 50% based on the total cross-sectional area of the composite coating layer.

When the average pore size of the pores is less than 5 μm, the resultant water vapor-permeable waterproof fabric may exhibit an unsatisfactory water vapor permeability, and when the average pore size of the pores is more than 50 μm, the resultant water vapor permeable waterproof fabric may exhibit an unsatisfactory resistance to water penetration.

Also, when the total cross-sectional area of the pores is less than 5% based on the total cross-sectional area of the composite coating layer, the resultant water vapor-permeable waterproof fabric may exhibit an insufficient water vapor permeability, and when the total cross-sectional area of the pores is more than 50%, the resultant fabric may exhibit an insufficient resistance to water penetration.

In the water vapor-permeable waterproof fabric of the present invention, optionally, in the cross-section of the fabric at right angles to the surface of the fabric, and in the interface portion between the composite coating layer and the substrate fabric, a portion of the individual fibers in the substrate fabric are completely coated in an amount of 20 to 1000 fibers per cm along the boundary face between the substrate fabric and the lower layer (A), with the polyetherester elastomer (PEEA) for the lower layer (A) to serve as anchor fibers for fixing between the substrate fabric and the lower layer (A), and 20 to 90% of the anchor fibers have peripheral surfaces of which 90% or more in area are spaced from the polyetherester elastomer (PEEB) of the upper layer (B) and are movable from the polyetherester elastomer (PEEB) of the upper layer (B).

When the number of the anchor fibers is less than 20 fibers per cm, the resultant water vapor permeable waterproof fabric may be disadvantageous in that the peeling strength between the substrate fabric and the lower layer (A) is unsatisfactory, and when it is more than 1000 fibers per cm, the resultant water vapor permeable waterproof fabric may exhibit too high a stiffness.

When the amount of the movable anchor fibers is less than 20%, the resultant water vapor permeable waterproof fabric may exhibit too high a stiffness, and when it is more than 90%, the resultant water vapor permeable waterproof fabric may exhibit an unsatisfactory peeling strength between the substrate fabric and the lower layer (A).

The process of the present invention for producing a water vapor-permeable waterproof fabric comprises coating at least a portion of the surfaces of a substrate fabric comprising a fiber material with a coating layer comprising (A) a lower layer and (B) an upper layer, wherein the lower layer (A) is formed on and bonded directly to at least a portion of the surface's of substrate fabric, and the upper layer (B) is formed on and bonded to the lower layer (A), and the lower and upper layers (A) and (B) comprise one of two polyetherester elastomers different in coating layer-forming property from each other, and each comprises polyalkylene glycol (PAG) residues, alkylene glycol (AG) residues and dicarboxylic acid (DC) residues, and satisfies the requirements (a), (b), (c) and (d), as mentioned above.

To form the lower layer (A) of the composite coating layer, a coating liquid containing a polyetherester elastomer (PEEA) for the lower layer (A) is prepared by dissolving the PEEA in a content of 2 to 30% by weight, preferably 10 to 25% by weight, in an organic solvent; the coating liquid is coated in an amount of 0.5 to 10 g/m$^2$ preferably 2 to 7 g/m$^2$ directly on at least a portion of the surfaces of the substrate fabric; and the organic solvent is removed from the PEEA-containing coating liquid layer on the substrate fabric.

Then an upper layer (B) of the composite coating layer is formed by preparing a coating liquid containing a polyetherester elastomer (PEEB) for the upper layer (B) dissolved in a content of 2 to 30% by weight, preferably 10 to 25% by weight, in an organic solvent; coating the PEEB-containing coating liquid in an amount of 5 to 30 g/m$^2$, preferably 10 to 20 g/m$^3$, on the lower layer (A); and removing the organic solvent from the PEEB-containing coating liquid layer on the lower layer (A).

Optionally, an intermediate layer (C) is formed, after the lower layer (A) is coated on the substrate fabric and before the upper layer (B) coated on the lower layer (A), by preparing a coating liquid for the intermediate layer (C) by dissolving a polyetherester elastomer (PEEC), different from the polyetherester elastomers PEEA and PEEB for the lower layer (A) and upper layer (B), in a content of 0.5 to 50% by weight, preferably 10 to 20% by weight in an organic solvent; and before the PEEB-containing upper layer (B) is coated on the lower layer (A), coating the PEEC-containing coating liquid in an amount of 0.1 to 10 g/m$^2$, preferably 2 to 7 g/m$^2$, on the lower layer (A); and removing the organic solvent from the coated PEEC-containing coating liquid layer. Thereafter the upper layer (B) is formed on the intermediate layer (C).

Optionally, the upper layer (B) is coated with an outer layer (D). The outer layer (D) is formed by preparing a coating liquid containing a polymeric material different from the polyetherester material PEEB for the upper layer (B), and preferably selected from water-repellent polymeric materials, silicone polymeric materials, and polyetherester elastomers which must be different from the polyetherester elastomers (PEEB) for the upper layer (B), and may be the same as the polyetherester elastomer (A) for the lower layer (A); and as the polyetherester elastomer (C) for the intermediate layer (c), and dissolved in a content of 0.5 to 50% by weight, preferably 10 to 30% by weight in an organic solvent; coating the polymeric material-containing coating liquid in an amount of 0.1 to 10 g/m$^2$, preferably 2 to 7 g/m$^2$, on the upper layer (B); and removing the organic solvent from the polymeric material-containing coating liquid layer formed on the upper layer (B).

The organic solvent for the lower, intermediate, upper or outer layer (A), (B), (C) or (D) preferably comprises at least one organic compound selected from those having a relatively low boiling temperature and no or less toxicity, for example dimethyl formamide, dioxane, 1,3-dioxolane, toluene, chloroform, and methylene chloride. Among those, 1,3-dioxolane having a low boiling temperature and toxicity is preferably used for this purpose. Preferably, the organic solvent contains 1,3-dioxolane in a content of 80% or more based on the total weight of the organic solvent. Usually, each of the polyetherester elastomers PEEA, PEEB and PEEC and the polymeric material for the outer layer (D) is preferably dissolved in a content of 2 to 30% by weight, more preferably 5 to 20% by weight based on the total weight of the organic solvent, at a temperature of 40 to 60° C., more preferably 45 to 55° C.

In the formation of the lower, upper, intermediate or outer layer the removal of the organic solvent from the coated coating liquid layer is carried out by at least one procedure selected from dry and wet solvent-removal procedures.

In the dry procedure, the organic solvent is evaporated away from the coating liquid layer at a temperature of, for example, 70 to 170° C., preferably 100 to 150° C., to solidify the coating liquid layer.

In the wet procedure, the coating liquid layer is brought into contact with a coagulating liquid which dissolves the organic solvent therein but does not dissolve the polymeric material in the coating liquid layer therein and thus the polymeric material is coagulated to form a solid coating layer. In the wet procedure, the coagulating liquid comprises, for example, hot water which is useful for solidifying a PEEA, PEEB or PEEC/1,3-dioxane solution.

The coating procedures are not limited to specific examples. Usually, the coating procedures can be carried out by conventional coating methods, for example, a knife coating method using a knife coater.

In the process of the present invention, a substrate fabric is directly coated with a lower layer (A), then optionally with an intermediate layer (C), indispensably with an upper layer (B), and optionally with an outer layer (D), to produce a coated fabric having a uniform thickness, a satisfactory water vapor-permeability and a sufficient resistance to water penetration under pressure.

Preferably, the PEEA containing lower layer (A) is formed in an amount of 0.5 to 10 g/m$^2$ and, more preferably 1 to 5 g/m$^2$. When the coating amount is less than 0.5 g/m$^2$, a thin coating layer having a uniform thickness may be difficult to be practically formed. When the coating amount is more than 10 g/m$^2$, the resultant composite coating layer-coated fabric may exhibit an unsatisfactory water vapor-permeability.

The PEEB-containing upper layer (B) is preferably formed in an amount of 5 to 30 g/m$^2$ more preferably 10 to 20 g/m$^2$. When the coating amount is less than 5 g/m$^2$ the resultant composite coating layer-coated fabric may exhibit an unsatisfactory resistance to water penetration under pressure. Also, if the coating amount is more than 30 g/m$^2$, the resultant composite coating layer-coated fabric may exhibit too high stiffness and a unsufficient water vapor permeability.

In the resultant water vapor-permeable waterproof fabric of the present invention produced by the above-mentioned process, the composite coating layer comprising a PEEA-containing lower layer (A) and a PEEB-containing upper layer (B) is formed.with a uniform thickness of the substrate fabric surface, and exhibits a high resistance to water penetration under pressure and a satisfactory water vapor-permeability. When the outermost surface is formed from a PEEB-containing outer layer (B) of which the alkylene glycol (AG) residues include ethylene glycol residues in a content of 30 molar % or more, more preferably 30 to 60 molar %, the resultant water vapor-permeable waterproof fabric can exhibit an enhanced wear resistance in addition to the satisfactory water vapor-permeability and the high water penetration resistance under pressure.

In the process for producing the water vapor-permeable waterproof fabric of the present invention, the water penetration resistance under pressure, the water vapor-permeability and the flexibility of the resultant fabric can be further enhanced in the following embodiments of the process.

First, to enhance the water penetration resistance under pressure of the fabric, it is preferable that the fabric water vapor-permeable waterproof of the present invention be further treated with a water repellent agent. The water repellent agent may be selected from conventional ones, for example, paraffin water repellent agents, polysiloxane water repellent agents and fluorine compound water repellent agents. The treatment for the fabric can be carried out by a conventional method, for example, a padding method or spraying method. The application of the water repellent agent is preferably carried out before or after the PEEA-containing coating liquid or the PEEB-containing coating liquid is applied. More preferably, the water repellent treatment is applied to the substrate fabric before the PEEA-containing coating liquid is applied. When the substrate fabric is previously treated with the water repellent agent, the penetration of the PEEA-containing coating liquid into the inside of the substrate fabric can be controlled.

Second, to enhance the water vapor-permeability, the PEEA-containing lower layer is formed into a porous structure in which a plurality of pores are distributed. The porous structure includes both independent pores which are separate from each other and connected pores which are connected to each other. The independent pore structure may be formed by preparing a coating liquid containing a polymeric material dissolved in an organic solvent and an additional liquid which may be water or additional organic liquid other than the organic solvent for the polymeric material, and which has a lower solubility for the polyetherester elastomers (PEE) than that of the organic solvent, has a higher boiling temperature than that of the organic solvent for the polymeric material and is dispersed in the form of fine particles; coating the coating liquid; removing the organic solvent having a lower boiling temperature for the polymeric material by a dry (evaporation) method to allow the polymeric material to be solidified; and then removing the additional liquid having the higher boiling temperature by a dry (evaporation) method to form the pores in the resultant polymeric material layer. Particularly, when the organic solvent for the polymeric material consists of 1,3-dioxolane, the additional liquid preferably comprise a member selected from water, toluene and ethyl acetate, and is used in an amount of 5 to 50% by weight based on the weight of 1,3-dioxolane. The coating layer formed by the above-mentioned procedures, has a plurality of independent pores having an average pore size of 0.1 to 10 $\mu$m.

The connected pores can be formed by the same procedures as those mentioned above, except that the removals of the organic solvent for the polymeric material are carried out by a wet method. In this case, when a cross-section of the resultant coating layer taken along the thickness direction thereof is observed, a plurality of pores connected to each other and to the ambient atmosphere and having an average pore size of 0.1 to 10 $\mu$m are found.

When the water vapor-permeable waterproof fabric having independent pores or connected pores has a total cross sectional area of the pores corresponding to 5 to 50% of the total surface area of the fabric, the resultant fabric can exhibit a significantly enhanced water vapor-permeability, without immoderately reducing the water penetration resistance under pressure and the mechanical strength thereof.

The independent and/or the connected pores may be formed in each or both of the PEEA-containing lower layer (A) and the PEEB-containing upper layer (B). As mentioned above, the formation of the independent and/or the connected pores in the coating layer contributes to minimizing the reduction of the water penetration resistance or the mechanical strength the coating layer. Thus, the independent and/or connected pores are preferably formed in the PEEA-containing lower layer (A). Also, preferably, the PEEB-containing upper layer contains no independent and/or connected pores. If it contains pores, the total cross-sectional area of the pores in the PEEB-containing upper layer is preferably controlled to 20% or less based on the total surface area of the upper layer.

Third, to enhance the flexibility of the water vapor-permeable waterproof fabric, it is preferable that, in the substrate fabric, the fibers located in the interface portion of the substrate fabric and the PEEA-containing lower layer and coated with the PEEA be kept in a freely movable condition. Particularly, in a cross-section of the water vapor-permeable waterproof fabric taken at right angles to the surface of the fabric and in the interface portion between the composite coating layer and the substrate fabric, some the individual fibers are completely coated on the peripheral surfaces thereof with the PEEA, which fibers are referred to as anchor fibers, and cause the PEEA-containing lower layer (A) and the PEEB-containing upper layer (B) to be fixed to the substrate fabric through the anchor fibers, are replaced by other fibers which are separated over at least 90% of the peripheral surface area thereof from the PEEA through gaps and are referred to movable anchor fibers. More, preferably, the anchor fibers are in the number of 20 to 1000 fibers per cm along a boundary line between the substrate fabric and the lower layer (A) and appearing in the cross section of the water vapor-permeable waterproof fabric, and the number of the movable anchor fibers corresponds to 20 to 90% of the total number of the anchor fibers. The movable anchor fibers can be provided by impregnating the substrate fabric with water in an amount of 0.5 to 50% by weight based on the weight of the substrate fabric, before coating the substrate fabric surface with the PEEA-containing lower layer (A). This is because when the water layer is formed on the surface of the substrate fabric, the direct contact of the fibers located in the surface portion of the substrate fabric with the PEEA applied thereto is restricted. The number of the anchor fibers and the number of the movable anchor fibers can be easily controlled by mixing an organic solvent capable of dissolving therein the PEEA into the water to be impregnated in the substrate fabric, or by controlling the amount of the water impregnated in the substrate fabric. This is because the degree of penetration of the PEEA-containing coating liquid for the lower layer (A) or the degree of direct contact of the fibers with the PEEA-containing coating liquid can be controlled. Also, in this procedure, since water is distributed between the fibers in the substrates fabric, the flexibility and air permeability of the substrate fabric, per se, can be enhanced.

In FIG. 1 showing a cross-sectional profile of an embodiment of the water vapor-permeable waterproof fabric of the present invention, a substrate fabric 1 is coated with a lower PEEA layer (A) 2 and then with an upper PEEB layer (B) 3.

In the boundary portion between the substrate fabric 1 and the lower layer 2, some of the individual fibers 4 are completely or incompletely coated on the peripheral surfaces thereof with the PEEA and serve as anchor fibers for fixing the composite coating layer (comprising the lower layer (A) 2 and the upper layer (B) 3) to the substrate fabric 1.

Some of the anchor fibers 4 are separated over at least 90% of the peripheral surface area thereof from the PEEA through gaps 7 and are referred to as movable anchor fibers 5.

Figure 2:
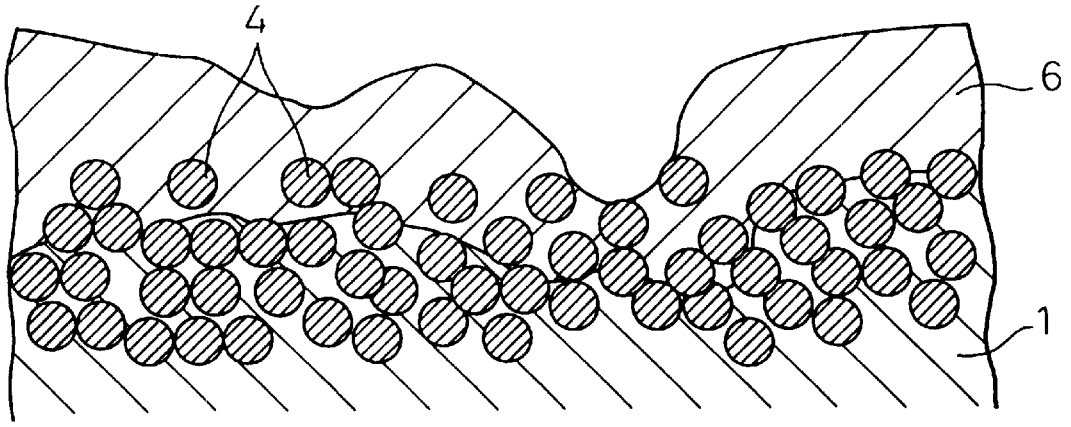
Fig.2 (PRIOR ART)
FIG. 2 shows a cross-sectional profile of an embodiment of conventional vapor permeable waterproof fabric in the direction of the thickness of the fabric.

In FIG. 2 showing a cross sectional profile of a conventional water vapor-permeable waterproof fabric, a single PEE coating layer 6 is coated on a substrates fabric 1 and some of the individual fibers 4 located in the boundary portion between the substrate fabric 1 and the PEE coating layer 6 serve as anchor fibers. The single PEE coating layer 6 has an uneven thickness and the surface thereof is rough.

The water vapor-permeable waterproof fabrics of the present invention can be employed along or in a combination with each other or with other article.

EXAMPLES

The present invention will be further illustrated by the following examples which are merely representative and do not restrict the scope of the present invention in any way.

The tests for the properties of the polymers used in the examples and of the products of the examples were carried out in the manners shown below.

(1) Intrinsic Viscosity of Polyetherester Elastomer (PEE)

The intrinsic viscosity of PEF was determined in a mixed solvent consisting of phenol and tetrachloroethane in a mixing weight ratio of 6:4 at a temperature of 35° C.

(2) Melting Temperature of PEE

The melting temperature of PEE was determined by a differential scanning calorimeter (Model: DSC 29290, made by TA INSTRUMENT) in a nitrogen gas stream at a temperature increasing rate of 10° C./minute.

(3) Contents of Ethylene Glycol or Tetramethylene Glycol in PEE

The content of ethylene glycol or tetramethylene glycol in PEE was determined by using an analyzer FT-NMR (Model: R1900, made by HITACHI SEISAKUSHO) at 90 MHz.

(4) Water Vapor Permeability

The water vapor permeability of a fabric was measured in accordance with JAPANESE INDUSTRIAL STANDARD (JIS) L 1099, A-1 Calcium chloride method.

(5) Water Penetration Resistance under Pressure

The water penetration resistance of a fabric under pressure was measured in accordance JIS L 1092, B(a) High water pressure method under hydrostatic pressure.

(6) Wear Resistance

An end portion of an abrasion member for an abrasion tester, mode II, in accordance with JIS L 0849 was covered, in a dry condition, with a rubbing white cotton fabric and a specimen to be tested was rubbed with the cotton fabric-covered abrasion member by reciprocally moving the abrasion member on the specimen 100 times at a distance of 10 cm at rate of 30 reciprocal movements per minute.

The rubbed specimen was subjected to the water penetration resistance test (5) and the resultant water penetration resistance was compared with the water penetration resistance of the non-rubbed (original) specimen. The wear resistance of the specimen was evaluated in response to the ratio (in %) of the water penetration resistance of the rubbed specimen to that of the original specimen as follows.

| Wear resistance | Water penetration resistance ratio |
|---|---|
| 3 | 90% or more |
| 2 | 50% or more but less than 90% |
| 1 | Less than 50% |

(7) The Numbers of Anchor Fibers and Movable Anchor Fibers

A specimen of a coated fabric was cross-cut along the direction of thickness of the fabric, and the cross-section of the fabric was observed by an electron microscope at a magnification of 1500. In the cross-section of the fabric, 100 cross-sections of fibers completely coated, on the peripheral surfaces thereof, with a polymeric material were counted along the boundary line between the substrate fabric and the lower layer (A), the number of the anchor fibers were calculated by dividing the 100 fibers with the distance in cm within which distance the 100 fibers were found and the number of the movable anchor fibers which have peripheral surfaces of which 90% or more in area are separated from the PEEA of the lower layer (A) through air gaps formed therebetween, was counted. The percentage in the number of the moval anchor fibers based on the total number of the anchor fibers in a fixed area was calculated.

The cross sections of the fibers subjected to the test were formed at a cutting angle of 60 to 12 degrees to the fiber axes. When the fibers are contained in a woven fabric, the cross-sections of the fibers were taken at right angles to the longitudinal axes of the warp yarns and to the longitudinal axes of the weft yarns. If the cross-section was taken along the axes of the fibers, it was difficult to judge whether the peripheral surfaces of the fibers were coated with the polymeric material.

(8) Peeling Strength

With reference to JIS K 6301, a melt adhesive tape was melt-adhered to a coating layer surface of a specimen (having a width of 2 cm and a length of 9 cm); free ends of the specimen and the melt-adhesive tape are respectively held by gripping members of a tensile tester facing each other and having a gripping width of 50 mm; the gripping members were moved in opposite directions at a tensile rate of 50 mm/minute, to peel off the melt adhesive tape from the specimen; an average peeling stress (except for the stress in the initial stage of the peeling off operation) was read; and an average stress per 25 mm width of the specimen was calculated, to determine the peeling strength of the specimen.

(9) Evaluation of Hand

The hand of the specimen was evaluated by an organoleptic touch test by five panel members. The relative hand evaluation result was represented in three classes as follows 3: Soft hand. No noise is generated due to friction of resin-coated layers when the specimen is bent.

2: Soft hand. A noise is generated due to friction of resin-coated layers when the specimen is bent.

1: Paper-like stiff hand. A noise is generated due to friction of resin-coated layers when the specimen is bent.

(10) Determination of Porous Structure of PEE-coated Layers

A lower layer (A) of a specimen of a water vapor permeable waterproof fabric was cross-cut, at a center portion thereof in the thickness direction, along a direction at right angles to the thickness direction of the specimen. Also, a upper layer (B) of the specimen was cross-cut in the same manner as mentioned above.

Each cross section was observed by an electron microscope at a magnification of 750. The number and cross-sectional areas of the pores found in a square area of 100 $\mu$m×100 $\mu$m in the cross section were measured. From the cross-sectional areas, an average cross-sectional area of the pores was calculated, and a diameter of a circle having the same area as the average cross-sectional area was calculated. The average pore size of the pores is represented by the calculated diameter of the circle. Also, a proportion in % of a total cross-sectional area of the pores based on the square area, 100 $\mu$m×100 $\mu$m=10,000 $\mu m^2$, was calculated.

Polymer Production Examples 1 to 4

Preparation of PEEB and Comparative PEE

In Polymer Production Example 1, a reaction mixture of 194 parts by weight of dimethyl terephthalate (DMT) with 43.3 parts by weight of ethylene glycol (EG), 72 parts by weight of tetramethylene glycol (TMG), 124 parts by weight of polyethylene glycol (PEG) having an average molecular weight of 4,000 and 0.341 part of a catalyst consisting of tetrabutyl titanate was placed in a reactor equipped with a distillation apparatus; and was subjected to a transesterification reaction at a temperature of 220° C. for 10 minutes, while removing a by-product consisting of,methyl alcohol from the reactor. After the transesterification reaction was completed, the resultant reaction mixture was placed in a reactor equipped with a stirrer, a nitrogen gas-introducing inlet, a pressure-reduction outlet and a distillation apparatus and heated to a temperature of 240° C., mixed with 0.31 part of a thermal stabilizer (trademark: SUMILIZER GS, made by, SUMITOMO KAGAKUKOGYO K.K.); the air in the reactor was replaced by a nitrogen gas, the reaction mixture was subjected to a poly-condensation reaction at the above mentioned temperature under the ambient atmospheric pressure for about 10 minutes, and under a pressure of 1995 to 2660 Pa (15 to 20 mmHg) for about 30 minutes, and then was heated to a temperature of 255° C. under a pressure of 13.3 Pa (0.1 mmHg), to continue the polycondensation reaction. After the melt viscosity of the reaction mixture reached a target level, an anti-oxidant (trademark: SUMILIZER GA-80, made by SUMITOMO KAGAKUKOGYO K.K.) was added in an amount of 0.62 part to the reaction mixture to stop the polycondensation reaction. The resultant polymer was pelletized by a conventional pellet-forming method. The resultant polyetherester elastomer (PEEB) for the upper layer (B) had an intrinsic viscosity of 1.163, a melting temperature of 176° C. and a content ratio (EG/TMG) of EG and TMG was 33/67.

In each of Polymer Production Examples 2 to 4, the same procedures as in Polymer Production Example 1 were repeated except that the weight contents of PEG and PTMG in the reaction mixture were changed to as shown in Table 1.

Each of the resultant polyetherester elastomers (PEEB) for the upper layer (B) was completely dissolved in an amount of 5 parts by weight in 95 parts by weight of 1,3-dioxolane heated to a temperature of 60° C. to provide a coating liquid for the upper layer (B). The coating liquid was spread on a glass plate, and dried and heat-treated at a temperature of 150° C. for 10 minutes to provide a PEEB film.

The properties of the PEEB films of Polymer Production Examples 1 to 4 are shown in Table 1.

TABLE 1

| Polymer Production Example No. | PEG/PTMG weight ratio | Weight $g/m^2$ | Water vapor-permeability $g/m^2 \cdot 24$ h | Tensile strength N/cm | Ultimate elongation % |
|---|---|---|---|---|---|
| 1 | 100/0 | 20 | 5100 | 2940 | 560 |
| 2 | 75/25 | 20 | 4000 | 2940 | 600 |
| 3 | 50/50 | 20 | 3600 | 2940 | 600 |
| 4 (Comparative) | 0/100 | 20 | 1500 | 2450 | 650 |

Polymer Production Example 5

Preparation of PEEA

A reaction mixture of 210 parts by weight of dimethyl terephthalate (DMT) with 63.6 parts by weight of isophthalic acid (IA), 193.3 parts by weight of tetramethylene glycol (TMG) and 199 parts by weight of polytetramethylene glycol (PTMG) was placed in a reactor and was subjected to a transesterification reaction at a temperature under the ambient atmospheric pressure for 180 minutes, to provide an etherester monomer. Then, the monomer was subjected to a polycondensation reaction while increasing the reaction temperature and reducing the reaction pressure, to provide a polyetherester elastomer (PEEA). In the above-mentioned reactions, the isophthalic acid was one in the state of an aqueous slurry, and the PTMG had a number average molecular weight of 2,000. The resultant PEEA had an intrinsic viscosity of 1.0 and a melting temperature of 170° C.

Example 1

A polyester fiber substrate fabric treated with a water repellent agent (trademark: LS-317, made by MEISEI KAGAKU K.K., a fluorine compound-containing water repellent agent having a solid content of 1.0% by weight) and having a water penetration resistance of 5.88 kPa (600 $mmH_2O$) and a water vapor-permeability of 9000 $g/m^2 \cdot 24$ hr, was coated with a lower layer (A)-coating liquid prepared by completely dissolving 10 parts by weight of the PEEA produced in Polymer Production Example 5 in 90 parts by weight of ethylene formal heated at a temperature of 50° C., by using a knife coater in the coating procedure, a clearance between the substrate fabric surface and the edge of the knife coater was controlled to adjust the coating amount of the coating liquid to 5 $g/m^2$ by dry weight. The coated coating liquid was dried and heat-treated at a temperature of 130° C. for one minute.

Then, the lower layer surface was coated with an upper layer-coating liquid prepared by completely dissolving 7 parts by weight of the PEEB (PEG/PTMG=100:0) produced in Polymer Production Example 1 in 93 parts by weight of ethylene formal heated at a temperature of 60° C., to form a PEEB-containing coating liquid layer in a dry amount of 15 $g/m^2$ on the lower layer, and dried and heat-treated at a temperature of 150° C. for 3 minutes.

The resultant water vapor-permeable waterproof fabric of Example 1 exhibited a high water vapor-permeability and an excellent water penetration resistance under pressure, as shown in Tables 2 and 3.

The total thickness of the lower and upper layers was 16 μm.

The lower layer was in an amount of 25% based on the total weight of the lower and upper layers.

The test results are shown in Tables 2, 3, 5 and 6.

Comparative Example 1

A water vapor-permeable waterproof fabric was produced by the same procedures as in Example 1 except that the PEEA-containing lower layer (A) was not Coated on the substrate fabric.

The test results are shown in Table 2.

Example 2 and Comparative Example 2

In each of Example 2 and Comparative Example 2, a water vapor-permeable waterproof fabric was produced by the same procedures as in Example 1, except that the weight ratio of PEG to PTMG in the PEEA produced in Polymer Production example 5 was changed to as shown in Table 2.

The test results are shown in Table 2.

TABLE 2

| | Item | | | | |
|---|---|---|---|---|---|
| Example No. | PEEA PEG/PTMG weight ratio | PEEA weight ($g/m^2$) | Total thickness of composite coating layer (μm) | Water vapor-permeability ($g/m^2 \cdot 24$ h) | Resistance to water penetration (kPa) |
| Example 1 | 0/100 | 5 | 16 | 6500 | 235.4 |
| Comparative Example 1 | — | — | 10.5 | 6700 | 29.4 |
| Example 2 | 10/90 | 5 | 15 | 6500 | 147.1 |
| Comparative Example 2 | 70/30 | 5 | 12.0 | 6600 | 63.7 |

As Table 2 shows, in each of Examples 1 and 2 in accordance with the present invention, the resultant water vapor-permeable waterproof fabric had a PEEA-containing lower layer and a PEEB-containing uppers layer uniformly coated on the substrate fabric and exhibited a high water penetration resistance under pressure and an excellent water vapor-permeability.

In Comparative Example 1 wherein the PEEA-containing lower layer was omitted, the PEEB-containing coating liquid easily penetrated in a large amount into the inside of the substrate fabric and the resultant PEEB-containing upper layer was uneven, and the resultant water vapor-permeable waterproof fabric exhibited a very poor water penetration resistance.

In Comparative Example 2 in which the PEEA-containing lower layer exhibited a poor coating layer forming property, both of the PEEA-containing coating liquid and the PEEB-containing coating liquid easily penetrated into the inside of the substrate fabric and the resultant composite coating layer was uneven and exhibited a poor water penetration resistance under pressure.

Examples 3 and 4

In each of Examples 3 and 4, a water vapor-permeable waterproof fabric was produced by the same procedures as in Example 1, except that in the AG residues of the PEEB, the weight ratio of EG to TMG was changed to as shown :in Table 3.

The wear resistance test results are shown in Table 3.

TABLE 3

| | Item | | | | |
|---|---|---|---|---|---|
| Example No. | PEEB EG/TMG | Total thickness of composite coating layer (μm) | Water penetration resistance (kPa) | Water vapor permeability ($g/m^2 \cdot 24$ hr) | Wear resistance |
| Example 1 | 33/67 | 16 | 235.4 | 6500 | 3 |
| Example 3 | 50/50 | 15 | 225.6 | 6400 | 3 |
| Example 4 | 28/72 | 15 | 226.5 | 6400 | 2 |

Table 3 shows that in Example 3 in which the AG residues of the PEEB contained ethylene glycol residues and tetramethylene glycol residue in a molar ratio of 50:50, the resultant water vapor-permeable waterproof fabric had satisfactory wear resistance, water penetration resistance and water vapor-permeability. In Example 4 in which the AG residues of the PEEB contained ethylene glycol residues and tetramethylene glycol residues in a molar ratio of 28:72, the resultant water vapor-permeable waterproof fabric exhibited satisfactory water penetration resistance.

Examples 5 to 7

In each of Examples 5 to 7, a water vapor-permeable waterproof fabric was produced by the same procedures as in Example 1, except that the PEEA-containing lower layer (A) and the PEEB-containing upper layer (B) were formed in the amounts shown in Table 4.

The test results are shown in Table 4.

TABLE 4

| | Item | | | | | | |
|---|---|---|---|---|---|---|---|
| Example No. | PEEA-containing lower layer ($g/m^2$) | PEEB-containing upper layer ($g/m^2$) | Total thickness of composite coating layer (μm) | Percentage in weight of lower layer (%) | Water penetration resistance (kPa) | Water vapor-permeability ($g/m^2 \cdot 24$ h) | Wear resistance |
| 5 | 2 | 20 | 15 | 90.9 | 196.1 | 6700 | 3 |
| 6 | 10 | 20 | 24 | 33.3 | 255.0 | 5200 | 3 |
| 7 | 5 | 25 | 23 | 20.0 | 245.2 | 6000 | 3 |

Example 8

A water vapor-permeable waterproof fabric was produced by the same procedures as in Example 1, except that the substrate fabric was impregnated, before the PEEA-containing coating liquid was applied to the substrate fabric, with an aqueous solution containing 0.5% by weight of a nonionic sulfonate surface-active, agent (trademark: TJCO43, made by TAKEMOTO YUSHI K.K.) in an amount of 40% by weight based on the weight of the substrate fabric.

The test results are shown in Table 5.

Example 9

A water vapor-permeable waterproof fabric was produced by the same procedures as in Example 8, except that the aqueous surface active agent solution further contained 20% by weight of 1,3-dioxolane.

The test results are shown in Table 5.

Example 10

A water vapor-permeable waterproof fabric was produced by the same procedures as in Example 9, except that the aqueous solution containing the surface active agent and 1,3-dioxolane was impregnated in an amount of 10% by weight in the substrate fabric.

The test results are shown in Table 5.

Example 11

A water vapor-permeable waterproof fabric was produced by the same procedures as in Example 9, except that the aqueous solution of the surface active agent and 1,3-dioxolane was impregnated in an amount of 50% by weight in the substrate fabric.

The test results are shown in Table 5.

Example 12

A water vapor-permeable waterproof fabric was produced by the same procedures as in Example 8, except that the aqueous solution containing the surface active agent was impregnated in an amount of 0.1% by weight in the substrate fabric.

The test results are shown in Table 5.

TABLE 5

| Example No. | The number of anchor fibers (fibers/cm) | Percentage of movable anchor fibers (%) | Total thickness of composite coating layer (μm) | Water penetration resistance (kPa) | Water vapor permeability ($g/m^2 \cdot 24$ h) | Peeling strength (N/25 mm) | Hand |
|---|---|---|---|---|---|---|---|
| 1 | 96 | 12 | 16 | 235.4 | 6500 | 6.37 | 2 |
| 8 | 216 | 45 | 15 | 215.7 | 7000 | 5.88 | 3 |
| 9 | 340 | 39 | 15 | 205.9 | 7100 | 5.98 | 3 |
| 10 | 144 | 29 | 16 | 225.6 | 6700 | 6.17 | 3 |
| 11 | 412 | 63 | 15 | 166.7 | 7400 | 5.39 | 3 |
| 12 | 124 | 20 | 16 | 225.6 | 6600 | 6.27 | 3 |

Table 5 shows that in Examples 8 to 12, the movable anchor fibers were in an amount of 20% or more, thus the resultant water vapor-permeable waterproof fabrics had a peeling strength sufficient for practical use, a high flexibility and a good hand, and no unpleasant noise was generated upon bending.

Example 13

A water vapor-permeable waterproof fabric was produced by the same procedures as in Example 1, except that after the coating liquid containing the PEEA dissolved in 1,3-dioxolane was applied to the substrate fabric, the removal of 1,3-dioxolane from the resultant coating liquid layer by the dry-heat treatment at a temperature of 130° C. was replaced by a wet removal of 1,3-dioxolane by bringing the coating liquid layer into contact with hot water at a temperature of 70° C.

The test results are shown in Table 6.

TABLE 6

| | Item | | | | | | |
|---|---|---|---|---|---|---|---|
| | Lower Layer (A) | | Upper Layer (B) | | Total thickness | | |
| Example No. | Average pore size (μm) | Total pore area percentage (%) | Average pore size (μm) | Total pore area percentage (%) | of composite coating layer (μm) | Water penetration resistance (kPa) | Water vapor permeability ($g/m^2 \cdot 24$ h) |
| 1 | 0 | 0 | 0 | 0 | 16 | 235.4 | 6500 |
| 13 | 1.2 | 40 | 0 | 0 | 17 | 156.9 | 7900 |

As illustrated above, in the water vapor-permeable waterproof fabric of the present invention, at least a portion of the surfaces of the substrate fabric is coated with a lower layer (A) having a uniform thickness and comprising a polyetherester elastomer (PEEA) having a high coating layer-forming property, and the PEEA-containing lower layer A is coated with an upper layers: (B) comprising a polyetherester elastomer (PEEB) having a high water vapor-permeability. Therefore, even if the PEEB for the upper layer (B) exhibits a lower coating layer-forming property than that of the PEEA for the lower layer (A), the PEEB-containing upper layer (B) can form a uniform coating layer surface of the water vapor-permeable waterproof fabric. Thus, the.resultant water vapor-permeable waterproof fabric exhibits a high water; vapor-permeability and a high resistance to water penetration under pressure. Further, when the content of tetramethylene glycol residues in the alkylene glycol residue of the PEEB for the upper layer (B) is controlled to 30 molar % or more, the resultant PEEB-containing upper layer exhibits an enhanced wear resistance. Also, in the water vapor-permeable waterproof fabric of the present invention, the composite coating layer is formed from polyetherester elastomers which do not generate harmful gas upon combustion thereof. Therefore, when the water vapor-permeable waterproof fabric of the present invention is discarded, no specific treatment is necessary for the fabric and no environment-pollution problem occurs.

What is claimed is:

1. A water vapor-permeable waterproof fabric comprising:

a substrate fabric comprising a fiber material; and a composite coating layer formed on at least a portion of the surfaces of the substrate fabric and containing (A) a lower layer directly bonded to the substrate fabric and (B) an upper layer formed on the lower layer, wherein the lower and upper layers (A) and (B) comprise one of two polyetherester elastomers (PEE) different in coating layer-forming property from each other, and each comprising polyalkylene glycol (PAG) residues, alkylene glycol (AG) residues and dicarboxylic acid (DC) residues, and satisfy the following requirements:

(a) in the polyetherester elastomer (PEAA) for the lower layer (A), the polyalkylene glycol (PAG) residues contain polytetramethylene glycol residues in a content of 90% by weight or more;

(b) in the polyetherester elastomer (PEEB) for the upper layer (B), the polyalkylene glycol (PAG) residues contain polyethylene glycol residues in a content of 50% by weight or more;

(c) the thickness of the composite coating layer is in the range of from 5 to 50 $\mu$m; and (d) the lower layer (A) is in an amount of 5 to 40% by weight based on the total weight of the composite coating layer including the lower and upper layers (A) and (B), wherein in the cross-section of the water vapor-permeable waterproof fabric at right angles to the surface of the fabric, and in the interface portion between the composite coating layer and the substrate fabric, some of the individual fibers in the substrate fabric are completely coated in an amount of 20 to 1000 fibers per cm along a boundary line between the substrate fabric and the lower layer (A) and appearing in the cross-section, with the polyetherester elastomer (PEAA) for the lower layer (A) to serve as anchor fibers for fixing between the substrate fabric and the lower layer (A) and 20 to 90% of the anchor fibers have peripheral surfaces of which 90% or more in area are spaced from the polyetherester elastomer (PEAA) of the lower layer (A) and are movable from the polyetherester elastomer (PEAA) of the lower layer (A).

* * * * *